US007285715B2

(12) United States Patent
Sasaki et al.

(10) Patent No.: US 7,285,715 B2
(45) Date of Patent: Oct. 23, 2007

(54) VELOCITY ESTIMATOR FOR MANIPULATORS AND MUSICAL INSTRUMENT USING THE SAME

(75) Inventors: Tsutomu Sasaki, Hamamatsu (JP); Yuji Fujiwara, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/331,670

(22) Filed: Jan. 13, 2006

(65) Prior Publication Data

US 2006/0201313 A1 Sep. 14, 2006

(30) Foreign Application Priority Data

Mar. 14, 2005 (JP) ..... 2005-070780

(51) Int. Cl.
*G10H 1/02* (2006.01)
*G10F 1/02* (2006.01)
*G10H 3/06* (2006.01)

(52) U.S. Cl. ..... 84/737; 84/724; 84/21

(58) Field of Classification Search ..... 84/626, 84/724

See application file for complete search history.

(56) References Cited

U.S. PATENT DOCUMENTS 5,652,399 A * 7/1997 Fujiwara et al. ..... 84/21

FOREIGN PATENT DOCUMENTS

JP 2001-175262 6/2001

OTHER PUBLICATIONS

Multiple Linear Regression—http://www.mathpages.com/home/kmath035.htm—Jan. 9, 2007.*

* cited by examiner

*Primary Examiner*—Lincoln Donovan
*Assistant Examiner*—Andrew Millikin
(74) *Attorney, Agent, or Firm*—Morrison & Foerster LLP

(57) ABSTRACT

An automatic player piano is a combination between an acoustic piano and an electronic system serving as a recorder and an automatic player; while a user is fingering a piece of music on the acoustic piano, the player strongly depresses some keys and softly depresses other keys so as to give artistic expression to the tones, and the depressed keys give rise to hammer motion at different values of hammer velocity; since the hammer velocity is proportional to the loudness of tones, the controller is expected exactly to determine the hammer velocity; the hammers travel on linear trajectories and parabolic trajectories depending upon the hammer velocity so that the controller estimates the hammer velocity by using different methods, whereby the controller can produce music data codes exactly expressing the tones to be produced.

17 Claims, 11 Drawing Sheets

| | | |
|---|---|---|
| 1 | AD | TIME |
| 2 | AD | TIME |
| 3 | AD | TIME |
| ⋮ | ⋮ | ⋮ |
| 20 | AD | TIME |

TABLE1

Fig. 6

TABLE 2

| TIME T | BINARY NUMBER AD | CALCULATIVE VELOCITY Vc | ESTIMATED HM. VELOCITY V |
|---|---|---|---|
| 0 | x(−5) | Vc(−5) | ⋮ |
| 1 | x(−4) | Vc(−4) | |
| ⋮ | ⋮ | ⋮ | ⋮ |
| 5 | x(0) | Vc(0) | |
| ⋮ | ⋮ | ⋮ Vc(3) ⋮ | ⋮ |
| 10 | x(5) | Vc(5) | V(5) |

Fig. 11

| n | 5 | 7 | 9 | 11 | 13 |
|---|---|---|---|---|---|
| m | 2 | 3 | 4 | 5 | 6 |
| W | 10 | 28 | 60 | 110 | 182 |
| j | wj | wj | wj | wj | wj |
| −6 | | | | | −6 |
| −5 | | | | −5 | −5 |
| −4 | | | −4 | −4 | −4 |
| −3 | | −3 | −3 | −3 | −3 |
| −2 | −2 | −2 | −2 | −2 | −2 |
| −1 | −1 | −1 | −1 | −1 | −1 |
| 0 | 0 | 0 | 0 | 0 | 0 |
| 1 | 1 | 1 | 1 | 1 | 1 |
| 2 | 2 | 2 | 2 | 2 | 2 |
| 3 | | 3 | 3 | 3 | 3 |
| 4 | | | 4 | 4 | 4 |
| 5 | | | | 5 | 5 |
| 6 | | | | | 6 |

Fig. 12

VELOCITY ESTIMATOR FOR MANIPULATORS AND MUSICAL INSTRUMENT USING THE SAME

FIELD OF THE INVENTION

This invention relates to an estimator for a physical quantity expressing motion of a component part of a system and, more particularly, to a velocity estimator for estimating final velocity of manipulators such as, keys, and a musical instrument equipped with the velocity estimator.

DESCRIPTION OF THE RELATED ART

An automatic player piano is a typical example of the hybrid musical instrument. The automatic player piano is a combination of an acoustic piano and an electronic system, and users enjoy themselves recording and reproducing pieces of music by means of the electronic system. Sensors are required for the recording and playback through a servo control.

A typical example of the hammer sensor is disclosed in Japanese Patent Application laid-open No. 2001-175262. The prior art hammer sensors continuously convert the stroke of the associated hammer to hammer position signals. The physical quantity, which expresses the hammer motion, is reported to the controller through the hammer position signals, and the physical quantity is analyzed by the controller. The controller obtains pieces of motion data through the analysis, and the pieces of motion data express (1) timing at which the hammers start to travel on their trajectories, (2) timing at which the hammers are brought into collision with the associated strings, (3) hammer velocity immediately before the collision, (4) timing at which the associated keys start to travel on their trajectories, (5) timing at which the hammers are captured by the back checks, (6) timing at which the back checks are released from the hammers, (7) hammer velocity after the release of the back checks, (8) timing at which the dampers are brought into contact with the strings, (9) timing at which the hammers return to the rest position, and (10) timing at which the associated keys are released.

When the controller determines the hammer velocity, the controller reads out the values of the hammer stroke, which were sampled on the hammer position signal at regular intervals, and calculates the gradient at a target hammer position. The hammer velocity immediately before the collision with the strings is proportional to the loudness of the tones. For this reason, while a user is playing a piece of music on the acoustic piano for the recording, the controller determines values of the hammer velocity immediately before the collision, and memorizes the values of the hammer velocity in music data codes together with the key numbers already assigned to the keys depressed by the user. When the user instructs the electronic system to reenact the performance, the controller sequentially processes the music data codes, and gives rise to the key motion so as to make the hammers brought into collision with the strings at the target hammer velocity.

As known to persons skilled in the art, the hammer start the free rotation at the escape of the jacks of the action units, which are actuated with the keys, so that the controller can not directly control the hammer velocity after the escape. However, the key velocity at certain points on the key trajectories is proportional to the hammer velocity immediately before the collision with the strings. For this reason, the controller regulates the force to proper value in such a manner that the keys pass the certain points on the key trajectories at target key velocity.

The prior art controller causes the hammers to be brought into collision with the strings at the hammer velocity close to that in the original performance so that the user feels the playback fairly close to his or her original performance. However, the user sometimes feels the diminuendo and crescendo vague rather than those in the original performance. A problem inherent in the prior art is the poor fidelity in the artistic expression.

SUMMARY OF THE INVENTION

It is therefore an important object of the present invention to provide an estimator, which makes a hybrid musical instrument reenact a performance at high fidelity.

It is also an important object of the present invention to provide the hybrid musical instrument, which is equipped with the estimator.

The present inventors contemplated the problem inherent in the prior art, and conducted experiments at different hammer velocity, i.e., in relatively high-speed hammer motion and relatively low-speed hammer motion. When the present inventor strongly depressed a key, the depressed key gave rise to the free rotation at the relatively high-speed, and, thereafter, the hammer rebounded on the string at the end of the free rotation. The present inventors plotted the hammer position with respect to the time as shown in FIG. 1A, and confirmed that the hammer was moved from the rest position to the end position almost in the uniform motion. However, when the present inventor softly depressed the key, the hammer was moved from the rest position to an intermediate position almost in the uniform motion, and, thereafter, was decelerated as shown in FIG. 1B. The present inventors concluded that the controller was to estimate the final hammer velocity, i.e., the hammer velocity immediately before the collision in different manners depending upon the initial hammer velocity.

To accomplish the object, the present invention proposes to change methods for estimating another sort of physical quantity depending upon a character of motion such as a value of velocity.

In accordance with one aspect of the present invention, there is provided an estimator for a physical quantity expressing motion of a component part of a musical instrument comprising a data storage storing series of values of a piece of motion data expressing a sort of physical quantity varied on a trajectory on which the component part travels, and a data processor connected to the data storage, and determining another sort of physical quantity expressing the motion of the component part on the basis of the series of values of the piece of motion data through methods selectively used depending upon a characteristic of the motion.

In accordance with another aspect of the present invention, there is provided a musical instrument for producing pieces of music data expressing tones comprising plural series of links having respective certain links traveling on trajectories, respectively, for specifying the tones to be produced, sensors producing signals representative of pieces of motion data expressing a sort of physical quantity varied on the trajectories so that plural series of values of the pieces of motion data express motion of the certain links on the trajectories, an estimator connected to the sensors and including a data storage storing the plural series of values of the pieces of motion data and a data processor connected to the data storage and determining another sort of physical quantity expressing the motion of the certain links on the plural series of values of the pieces of motion data through methods selectively used depending upon a characteristic of the motion, and a music data producer connected to the estimator, and producing pieces of music data expressing the tones, the pieces of music data containing sub-pieces of music data expressing an attribute of the tones determined on the basis of the aforesaid another sort of physical quantity.

BRIEF DESCRIPTION OF THE DRAWINGS

The features and advantages of the estimator and musical instrument will be more clearly understood from the following description taken in conjunction with the accompanying drawings, in which FIG. 6 is a view showing a queue of a piece of hammer position data, FIG. 11 is a view showing a table for storing pieces of hammer position data and sampling time, FIG. 12 is a view showing a table of coefficients used in calculation of an ordinary velocity.

DESCRIPTION OF THE PREFERRED EMBODIMENTS

Figure 1A:
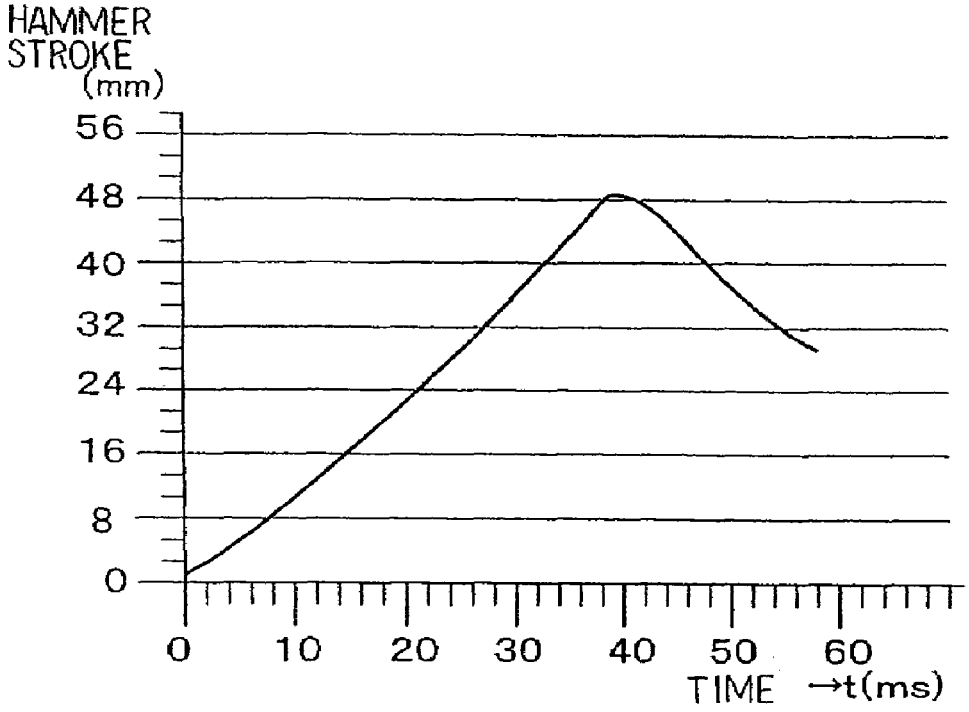
FIG. 1A is a graph showing relation between a hammer position and time in relatively high-speed motion.

A musical instrument embodying the present invention largely comprises plural series of links, sensors, an estimator and a music data producer. The plural series of links are selectively actuated for specifying tones to be produced. The sensors are associated with said plural series of links, and monitor certain links incorporated in the plural series of links. The sensors are connected to the estimator, which in turn is connected to the music data producer. The estimator and music data producer may be implemented by software.

While the certain links are traveling on the trajectories, the sensors produce signals representative of pieces of motion data expressing a sort of physical quantity varied on the trajectories, and the signals are supplied from the sensors to the estimator. Plural series of values of the pieces of motion data express motion of the certain links on the trajectories. The sort of physical quantity may be current positions of the certain links measured from the rest positions thereof.

The estimator includes a data storage and a data processor. The plural series of values of the pieces of motion data are stored in the data storage, and the data processor accesses the data storage for fetching the pieces of motion data. The data processor determines another sort of physical quantity expressing the motion of the certain links on the basis of the plural series of values of the pieces of motion data through methods selectively used depending upon a characteristic of said motion.

One of the methods may include an equation different from that in another method. Otherwise, values of another sort of physical quantity may be differently modified depending upon the characteristic of the motion. The characteristic may be the magnitude of the velocity of the certain links. If the motion is categorized in a high-speed motion, the data processor employs one of the methods. If, on the other hand, the motion is categorized in a low-speed motion, the data processor determines another sort of physical quantity through another of the methods. The magnitude of velocity does not set any limit to the technical scope of the present invention, because the motion may be characterized by magnitude of force exerted on the certain links by other links.

The data processor may determine other pieces of control data which express identification numbers assigned the certain links, times at which the tones are to be produced and a direction of the motion. These other pieces of control data and pieces of control data expressing another sort of physical quantity are fetched by the music data producer. The music data producer produces pieces of music data expressing said tones, and the pieces of music data contain sub-pieces of music data expressing an attribute of the tones determined on the basis of the another sort of physical quantity.

As will be understood from the foregoing description, the data processor according to the present invention discriminates the characteristic of motion, and determines another sort of physical quantity through methods selectively used. As a result, the tones to be produced are exactly adjusted to the attribute correlated with another sort of physical quantity.

Figure 1B:
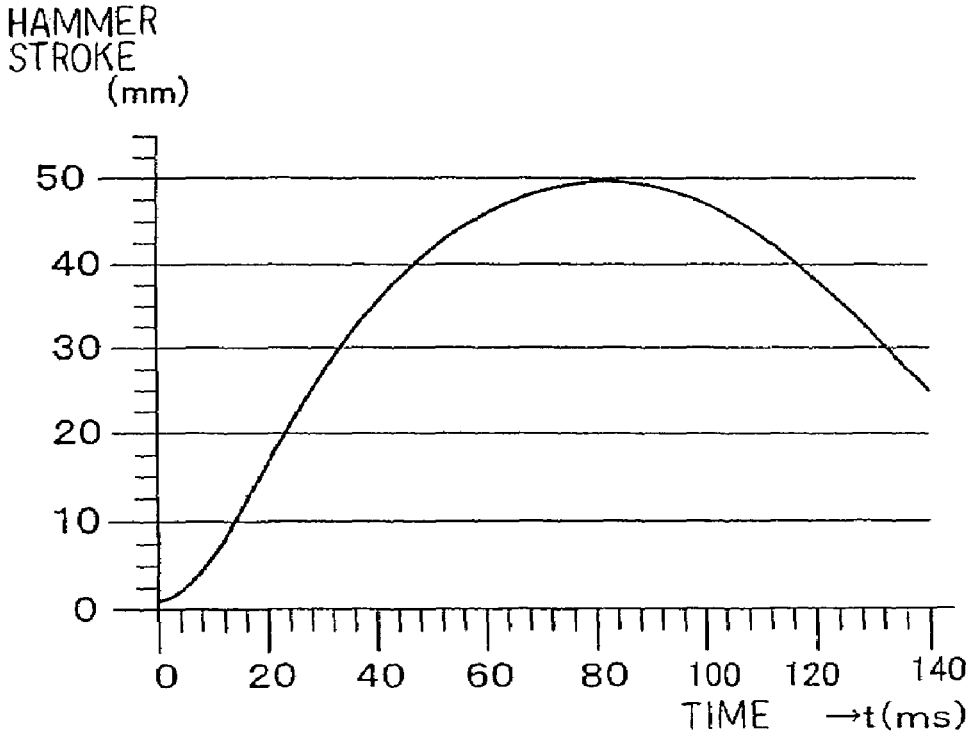
FIG. 1B is a graph showing relation between a hammer position and time in relatively low-speed motion.

For example, the characteristic of motion shown in FIGS. 1A and 1B is different from each other, i.e., high-speed motion and low-speed motion. Although the high-speed motion is approximated to a linear trajectory, a parabolic stands for the low-speed motion. In order to determine the final hammer motion immediately before the collision, the data processor exactly estimates the final hammer velocity on the assumption that the certain link travels on the assumption of the linear trajectory or parabolic trajectory. Thus, the estimator according to the present invention is conducive to the pieces of music data expressing the tones at high fidelity.

In the following description, term "front" is indicative of a position closer to a player, who is sitting for fingering, than a position modified with term "rear". A line drawn between a front position and a corresponding rear position extends in "fore-and-aft direction", and "lateral direction" crosses the fore-and-aft direction at right angle. "Up-and-down" direction is normal to a plane defined by the fore-and-aft direction and lateral direction. Component parts are staying at respective "rest positions" without any external force, and reach respective "end positions" at the end of the motion.

First Embodiment

Figure 2:
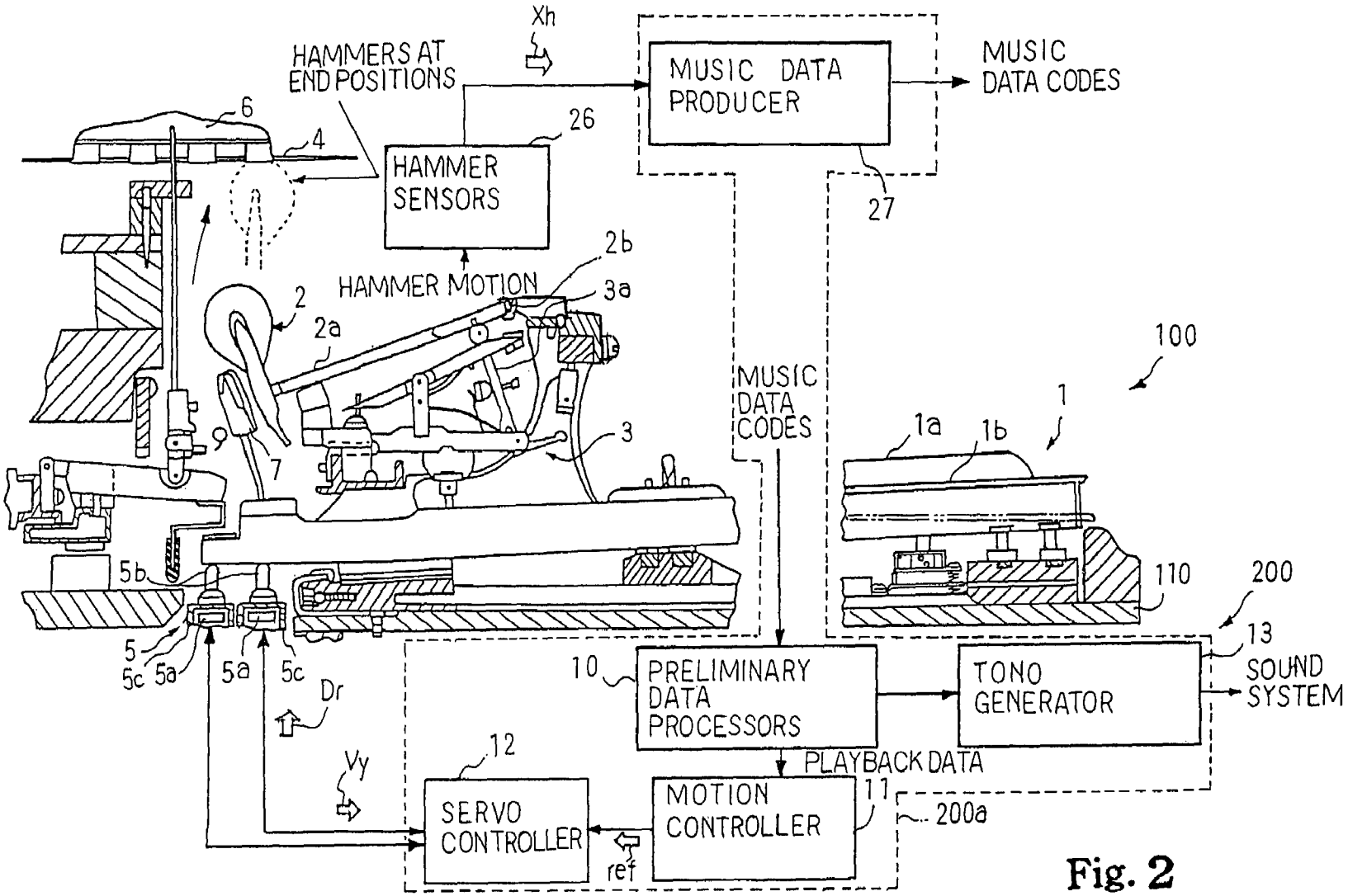
FIG. 2 is a cross sectional side view showing the structure of an automatic player piano according to the present invention.

Referring to FIG. 2 of the drawings, an automatic player piano embodying the present invention largely comprises an acoustic piano 100 and an electronic system 200. The electronic system 200 is installed in the acoustic piano 100, and serves as at least a recorder and an automatic player. A user is assumed to instruct the recorder to record his or her performance. While the user is playing a piece of music on the acoustic piano 100, the recorder analyzes key motion and pedal motion for piano tones produced in the acoustic piano, and memorizes pieces of music data expressing the tones to be produced in music data codes. On the other hand, when the user instructs the automatic player to reenact the original performance, the automatic player starts to process the music data codes, and reproduces the key motion and pedal motion for the tones identical with those in the original performance.

As will be hereinlater described in detail, an estimator is incorporated in the recorder. The estimator exactly estimates the physical quantity expressing motion, which results in the piano tones, and changes the method for the estimation depending upon characteristic of the motion. For this reason, the reproduced tones well show characteristics of the tones produced in the original performance so that the automatic player exhibits the artistic expression in the original performance at the high fidelity.

Acoustic Piano

The acoustic piano 100 includes a keyboard 1, which contains black keys 1*a* and white keys 1*b*, hammers 2, action units 3, strings 4 and dampers 6. Although the acoustic piano 100 further includes pedals, the pedals are not shown in FIG. 2.

The black keys 1*a* and white keys 1*b* are laterally arranged, and pitch up and down on a balance rail independently of one another. In this instance, eighty-eight keys 1*a*/1*b* form the well-known pattern. The keyboard 1 is mounted on a front portion of a key bed 110, which forms a part of a piano cabinet, and is exposed to a human player. The action units 3, hammers 2, strings 4 and dampers 6 are housed in the piano cabinet, and are exposed to the environment through an upper opening of the piano cabinet, which is opened and closed with a top board (not shown).

The action units 3 are provided over the rear portion of the black and white keys 1*a*/1*b*, and are respectively linked with the associated black and white keys 1*a*/1*b*. For this reason, a pianist selectively actuates the action units 3 through the black and white keys 1*a*/1*b*. The hammers 2 are held in contact with jacks 3*a*, which form parts of the action units 3, and are driven for rotation by the actuated action units 3 in the space over the action units 3. Each of the hammers 2 has a hammer shank 2*a*, which is rotatable about a hammer shank flange 2*b*.

The strings 4 are stretched over the hammers 2, and the hammers 2 are brought into collision with the associated strings 4 at the end of the rotation, i.e., the end positions. Then, the strings 4 vibrate, and the acoustic piano tones are produced through the vibrating strings 4. Broken lines are indicative of the hammers 2 at the end positions. In this instance, the hammer stroke from the rest positions to the end positions is designed to be 48 millimeters.

Back checks 7 upwardly project from the rear end portions of the associated black and white keys 1*a*/1*b*, and are moved together with the associated black and white keys 1*a*/1*b*. When the hammers 2 are brought into collision with the strings 4, the hammers 2 rebound on the strings 4, and are dropped down. The hammers 2 are captured by the associated back checks, and, thereafter, return to the rest positions together with the associated black and white keys 1*a*/1*b*. The back checks 7 prevent the strings 4 from double strike with the hammers 2.

The dampers 6 are linked at the lower ends thereof with the rear end portions of the black and white keys 1*a*/1*b*. While the black and white keys 1*a*/1*b* are staying at the rest positions, the dampers 6 are held in contact with the strings 4, and prohibit the strings 4 from resonance with other vibrating strings 4. When a player starts to depress the black and white keys 1*a*/1*b*, the front portions of the depressed keys 1*a*/1*b* begin the downward motion. Then, the rear portions of black and white keys 1*a*/1*b* are moved upwardly, and make the dampers 6 spaced from the strings 4. Thus, the dampers 6 permit the strings 4 to vibrate at intermediate points on the key trajectories of the associated black and white keys 1*a*/1*b*.

While a human player is fingering a piece of music on the keyboard 1, the depressed keys 1*a*/1*b* cause the associated action units 3 actuated, and the actuated action units 3 make the associated hammers 2 driven for rotation so that the strings 4 are struck with the hammers 2 at the end of the rotation. The vibrating strings 4 produce the acoustic piano tones along the piece of music. Thus, the acoustic piano 100 behaves as those well known to the persons skilled in the art.

Electronic System

The electronic system 200 includes a controller 200*a*, solenoid-operated key actuators 5 with built-in plunger sensors 5*a*, hammer sensors 26 and a sound system (not shown). The controller 200*a* is connected to the solenoid-operated key actuators 5, plunger sensors 5*a* and hammer sensors 26. The solenoid-operated key actuators 5 are hung from the key bed 110, and are laterally arranged below the rear portions of the black and white keys 1*a*/1*b*. The solenoid-operated key actuators 5 have respective plungers 5*b*, which are projectable from and retractable into the yoke 5*c*. When driving signals Dr flow into the solenoids, magnetic fields are created around the plungers 5*b*, and the plungers 5*b* upwardly project from the yoke 5*c*. The plungers 5*b* push the rear portions of the black and white keys 1*a*/1*b* so as to give rise to the key motion without any fingering of a human player. The plunger sensors 5*a* monitor the associated plungers 5*b*, and supply plunger velocity signals Vy representative of the plunger motion to the controller 200*a* so that the controller 200 optimizes the magnitude of the driving signals Dr. Thus, the controller 200*a*, solenoid-operated key actuators 5 and plunger sensors 5*b* form a servo control loop.

The hammer sensors 26 are respectively provided for the hammers 2, and report the physical quantity, which express the hammer motion, to the controller 200*a* through hammer position signals Xh. In this instance, hammer sensors 26 are categorized in an optical sensor. Light emitting diodes, optical fibers, light radiating sensor heads, light receiving sensor heads, optical fibers and light detecting transistors form the array of hammer sensors 26. The light emitting diodes are selectively connected to the light radiating sensor heads through bundles of optical fibers, and the light receiving sensor heads are selectively connected to the light detecting transistors through bundles of optical fibers. In this instance, twelve light emitting diodes and eight light detecting transistors are prepared for the eighty-eight hammers so that the light is supplied from each light emitting diode through the plural light radiating sensor heads and associated light receiving sensor heads to the eight light detecting transistors in one of the twelve time slots. In other words, the twelve light emitting diodes and eight light detecting transistors form a sensor matrix as disclosed in Japanese Patent Application laid-open No. Hei 9-54584, and the eighty-eight combinations in the sensor matrix are respectively assigned to the eighty-eight hammers 2.

The amount of light incident onto the light receiving sensor head is varied together with the current hammer position, and the light detecting transistor converts the incident light to the photo current, the amount of which is proportional to the amount of incident light. The photo current is converted to the potential level of the hammer position signals Xh. Thus, the hammer position signals Xh are representative of the hammer stroke or current hammer positions on the hammer trajectories. The hammer position signals are supplied to operational amplifiers (not shown) for amplification, and are, thereafter, supplied from the operational amplifiers to the controller 200*a*.

The hammer position signals Xh are periodically sampled, and the discrete values on the hammer positions signals Xh are converted to binary numbers AD through an analog-to-digital conversion. In this instance, the range of the binary numbers is equivalent from zero to 1023.

Figure 3:
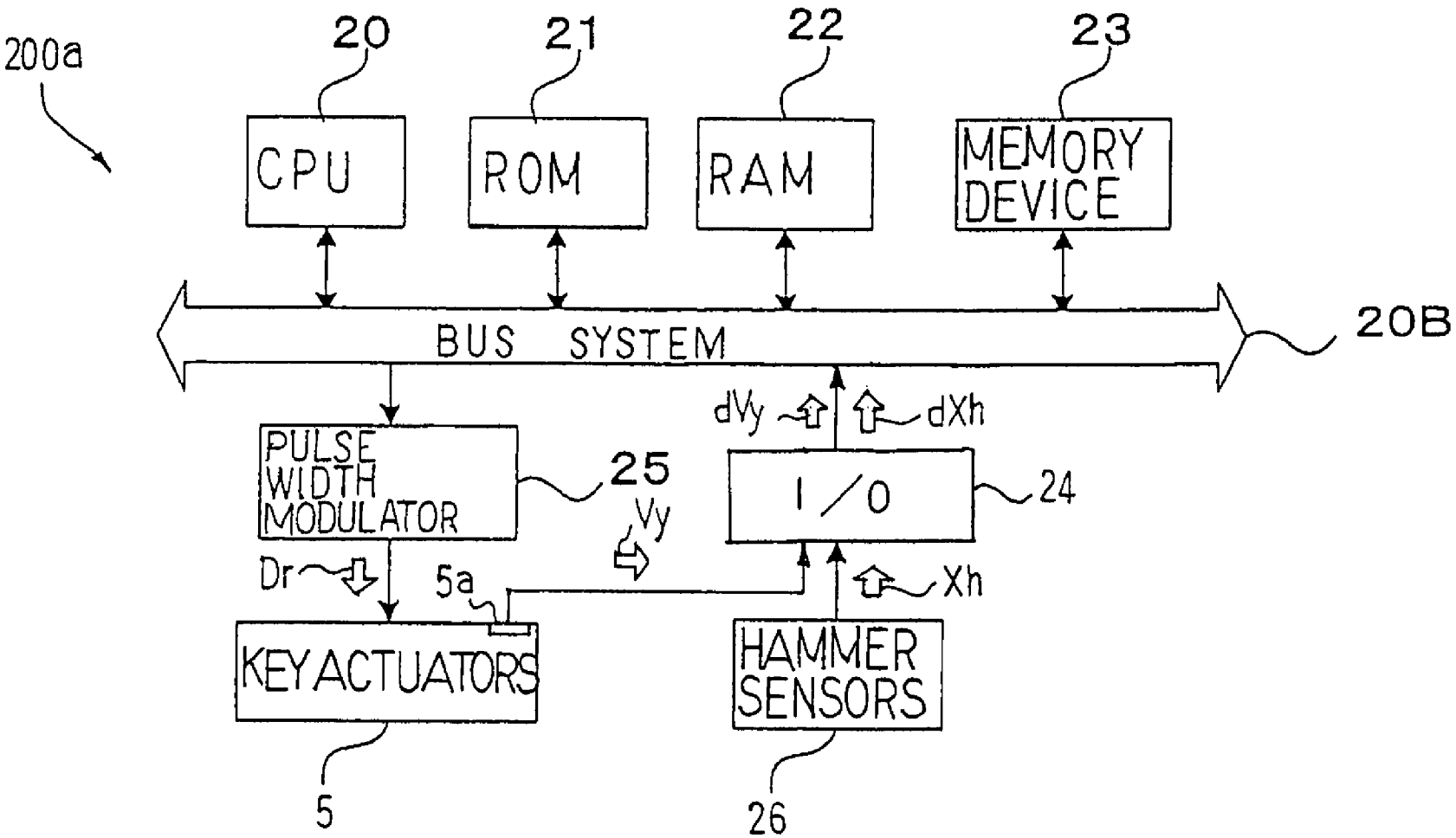
FIG. 3 is a block diagram showing the system configuration of a controller incorporated in the automatic player piano.

The system configuration of the controller 200*a* is illustrated in FIG. 3. The controller 200*a* includes a central processing unit 20, which is abbreviated as "CPU", a read only memory 21, which is abbreviated as "ROM", a random access memory 22, which is abbreviated as "RAM", a memory device 23, a signal interface 24, which is abbreviated as "I/O", a pulse width modulator 25 and a shared bus system 20B. The central processing unit 20, read only memory 21, random access memory 22, memory device 23, signal interface 24 and pulse width modulator 25 are connected to the shared bus system 20B so that the central processing unit 20 is communicable with the read only memory 21, random access memory 22, memory device 23, signal interface 24 and pulse width modulator 25 through the shared bus system 20B. Analog-to-digital converters are incorporated in the signal interface 24, and the hammer sensors 26 and plunger sensors 5*a* are connected to the analog-to-digital converters of the signal interface 24. On the other hand, the driving signals Dr are supplied from the pulse width modulator 25 to the solenoid-operated key actuators 5.

Although a communication interface and a MIDI interface are further connected to the shared bus system 20B, these system components are not shown in the drawings. The controller 200*a* is connectable to the Internet through the communication interface and to another musical instrument through the MIDI interface. The MIDI interface is designed for MIDI music data codes, and the abbreviation MIDI means the "musical instrument digital interface" protocols. A manipulating panel (not shown) is further connected to the shared bus system 20B, and users give their instructions to the central processing unit 20 through switches and keys on the manipulating panel. A display window and indicators are further prepared on the manipulating panel, and the central processing unit 20 reports current status and prompt messages through the indicators and display window.

The central processing unit 20 is the origin of data processing capability of the controller 200*a*, and the read only memory 21 is implemented by a flash memory. The central processing unit 20 sequentially executes instruction codes expressing jobs, and the automatic playing and recording are carried out through the jobs. The instruction codes are stored in the read only memory 21 so that the central processing unit 20 sequentially fetches the instruction codes from the read only memory 21 through the shared bus system 20B. Fundamental data are also stored in the read only memory 21, and the central processing unit 20 accesses the read only memory 21 in the data processing for the automatic playing and recording. A piece of the fundamental data expresses an individual position ratio between the rest position and the end position. The individual position ratio makes the binary values AD correlated with the hammer stroke as will be hereinlater described in detail.

The random access memory 22 serves as a working memory. While the central processing unit 20 is executing the jobs, data codes, which express pieces of intermediate data, and music data codes, which express tones to be produced, are temporarily stored in the random access memory 22. Several tables are defined in the random access memory 42, and areas of each table are respectively assigned to the eighty-eight keys 1*a*/1*b*. Pieces of hammer position data and pieces of plunger velocity data are selectively written in the areas in the tables.

The memory device 23 has a data holding capacity much larger than that of the random access memory 22, and is, by way of example, implemented by a hard disk, a flexible disk such as a floppy disk (trademark), a CD (Compact Disk) such as a CD-ROM, a MO (Magneto-Optical) disk, a zip, a DVD (Digital Versatile Disk) and/or a semiconductor memory board. The external memory unit 23 includes a driver for the above information storage medium. Data files, in which pieces of music are memorized, are stored in the external memory unit 43.

Data buffers are incorporated in the signal interface 24 together with the analog-to-digital converters. The hammer position signals Xh and plunger velocity signals Vy are periodically sampled, and the discrete values on the plunger velocity signals Vy and discrete values on the hammer position signals Xh are converted to digital codes, which are referred to as "digital plunger velocity signals dVy" and "digital hammer position signals dXh". The digital hammer position signals dVy and digital plunger velocity signals dVy are temporarily stored in the data buffers, and are fetched by the central processing unit 20. The sampling intervals are, by way of example, 1 milliseconds.

The pulse width modulator 25 is connected to the solenoids of the solenoid-operated key actuators 5, and is operative to adjust the driving signals Dr to a certain duty ratio. The central processing unit 20 informs the pulse width modulator 25 of the duty ratio for each of the solenoid-operated key actuators 5 associated with the black and white keys 1*a*/1*b* to be moved.

The shared bus system 20B includes data signal lines, address signal lines and control signal lines. Data codes such as, for example, music data codes and data codes expressing the duty ratio are propagated through the data signal lines, and address codes are supplied to the read only memory 21 and random access memory 22 through the address signal lines. Control signals such as, for example, an enable signal, a read-write signal, a select signal and a system clock signal are propagated through the control signal lines to the system components.

As described hereinbefore, the automatic playing and recording are carried out through the execution of instruction codes. The instruction codes form a computer program, and the computer program is broken down into a main routine program and subroutine programs. While the main routine program is running on the central processing unit 20, a user gives an instruction to the electric system 200 through the manipulating panel (not shown). When the central processing unit 20 acknowledges the user instruction, the main routine program branches to the subroutine program corresponding to the user instruction. One of the subroutine programs runs on the central processing unit 20 for the automatic playing, and another subroutine program runs for the recording. While the subroutine program is running on the central processing unit 40 for the automatic playing or recording, the subroutine program periodically branches to a subroutine program for data acquisition, and the pieces of plunger velocity data and pieces of hammer position data are transferred from the signal interface 24 to the random access memory 22.

Turning black to FIG. 2, function blocks 10, 11 and 12 are representative of the subroutine program for the automatic playing, and are called as a "preliminary data processor", a "motion controller" and a "servo controller", respectively. On the other hand, the subroutine program for the recording is expressed by a function block 27, which is called as a "music data producer".

The preliminary data processor 10, motion controller 11 and servo controller 12 behave in the automatic playing as follows. A user is assumed to instruct the electric system 200 to reenact a performance through the manipulating panel. The set of music data codes expressing the performance is transferred from a data source such as, for example, the memory device 23 or a server computer through the Internet to the random access memory 22, and the preliminary data processor 10 starts sequentially to process the pieces of music data memorized in the music data codes.

The preliminary data processor 10 searches the random access memory 22 to see whether or not there is found a music data code to be presently processed. When the preliminary data processor 10 finds the music data code or codes to be presently processed, the preliminary data processor 10 normalizes the pieces of music data and converts the unit of the physical quantity. If the music data codes were prepared in accordance with the MIDI protocols, the physical quantity are expressed in millimeter and millimeters per second. Thus, the preliminary data processor 10 firstly prepares a piece of playback data expressed in time, length and velocity for the motion controller 11.

The motion controller 11 determines a reference key trajectory ref on the basis of the piece of playback data for each black/white key 1*a*/1*b* to be depressed and released. The reference key trajectory ref is a series of values of a target key potion, and the black/white key 1*a*/1*b* is forced to travel on the reference key trajectory ref. If the black/white key 1*a*/1*b* exactly travels on the reference key trajectory ref, the black/white key 1*a*/1*b* passes a reference point at a target key velocity, which is proportional to a target hammer velocity immediately before the collision with the string 4, and the hammer 2 is expected to give rise to the vibrations of the string 4 for producing the acoustic piano tone at a target value of the loudness. The reference key trajectory ref is transferred from the motion controller 11 to the servo controller 12.

The servo controller 12 calculates a target key velocity on the basis of the target key position and an actual key position, which is equivalent to the actual plunger position, on the basis of the actual plunger velocity, and compares the target key position and target key velocity with the actual key position and actual key velocity to see whether or not the black/white key 1*a*/1*b* exactly travels on the reference key trajectory. When the black/white key 1*a*/1*b* is found at the target key position at the target key velocity, the servo controller 12 decides to keep the driving signal Dr at the present duty ratio, and requests the pulse width modulator 25 keep the duty ratio at the present value. On the other hand, if the servo controller 12 finds the black/white key 1*a*/1*b* to be advanced or delayed, the servo controller 12 calculates the difference between the actual key position and the target key position and the difference between the actual key velocity and the target key velocity, and determines a target duty ratio in such a manner as to minimize the differences. The servo controller 12 adjusts the driving signal Dr to the target duty ratio by means of the pulse width modulator 25 so that the plunger 5*b* and, accordingly, black/white key 1*a*/1*b* is decelerated or accelerated. Thus, the servo controller 12 forces the black/white keys 1*a*/1*b* to travel on the reference key trajectories. As a result, the black/white keys 1*a*/1*b* pass the reference points at the target key velocity, and gives rise to the target hammer motion which results in the acoustic piano tones at the target values of the loudness.

A user is assumed to record his or her performance on the acoustic piano 100. While the user is fingering on the keyboard 1 for producing the acoustic piano tones along a music passage, the hammer sensors 26 continuously report the current hammer positions through the hammer position signals Xh to the music data producer 27, and the music data producer 27 produces music data codes expressing the performance as follows.

In detail, the music data producer 27 converts the hammer position signals Xh to the digital hammer position signals dXh, and accumulates the pieces of hammer position data or series of binary values AD in the memory locations in assigned to the hammers 2. The music data producer 27 periodically analyzes the pieces of hammer position data for the tones to be produced and decayed. In more detail, the music data producer 27 specifies the hammers 2 driven for rotation, and determines key numbers assigned to the associated black/white keys 1*a*/1*b* as described in conjunction with the hammer sensors 26. The music data producer 27 calculates the final hammer velocity immediately before the collision with the strings 4 on the basis of the series of hammer position data and the time at which the hammers 2 are brought into collision with the strings 4. A method for calculating the final hammer velocity will be hereinlater described in more detail. Thus, the music data producer 27 prepares the pieces of music data expressing the key numbers, final hammer velocity, time to produce the tones and so forth.

Subsequently, the music data producer 27 normalizes the pieces of music data, and stores the pieces of normalized music data in music data codes. The music data producer 27 makes individualities of the acoustic piano 100 disregarded through the normalization. In this instance, the MIDI protocols are employed so that the tones to be produced and decayed are expressed as note-on events and note-off events. The note-on events and note-off events are defined by using the key number, velocity and time to produce or decay the tones.

The music data codes are output through the MIDI interface (not shown) or communication interface (not shown) to another musical instrument through a MIDI cable or an external data source through the communication network. Otherwise, the set of music data codes expressing the performance is stored in the memory device 23.

The hammer sensors 26 have individualities so that the binary numbers AD do not uniquely indicate particular hammer positions or particular values of the hammer stroke in different automatic player pianos. For this reason, the binary numbers AD are to be individually correlated with actual values of the hammer stroke. In order to make the binary numbers AD correlated with the actual values of the hammer stroke, four marked points are defined on each of the hammer trajectory. The first marked point and fourth marked point are the rest position and end position so that the hammer stroke is zero at the first marked point and 48 millimeters at the fourth marked point in an ideal acoustic piano. The second marked point M1 is spaced form the end position by 8 millimeters, and the third marked point M2 is spaced from the end position by 0.5 millimeter.

The individual position ratio is indicative of the ratio between the first marked point and the fourth marked point on the hammer trajectory for each hammer 2. A subroutine program expresses a settlement work for the individual position ratio, and forms a part of the computer program stored in the read only memory 21. A factory worker carried out the settlement work before the delivery to a user, and eighty-eight values have been memorized for the eighty-eight hammers 2 in the read only memory 21. However, the user or service worker can instruct the settlement work to the central processing unit 20 through the manipulating panel (not shown) so as to renew the values of the individual position ratio.

In the settlement work, the central processing unit 20 fetches the binary value AD at the rest positions for the eighty-eight hammers 2, and memorizes the binary values AD in the random access memory 22. Subsequently, the central processing unit 20 supplies pieces of test data expressing test key trajectories to the preliminary data processor 10, and the motion controller 11 and servo controller 12 force the black/white keys 1*a*/1*b* to travel on the test trajectories. As a result, the black/white keys 1*a*/1*b* give rise to the hammer motion, and the hammers 2 are brought into collision with the strings 4. The central processing unit 20 analyzes the series of binary numbers AD for the end positions, and determines the binary values AD at the end positions for the eighty-eight hammers 2. The central processing unit 20 calculates the individual position ratio between the rest positions and the end positions, and memorizes the individual position ratio in the read only memory 21 for the eighty-eight hammers 2. An individual position ratio between the rest positions and the marked points M1 and an individual position ratio between the rest positions and the marked points M2 are also determined, and memorized in the read only memory 21 for the eighty-eight hammers 2. The individual position ratio is described in Japanese Patent Application laid-open No. 2000-155579, and is referred to as "calibration ratio" in the Japanese Patent Application laid-open.

Using the individual position ratio, the central processing unit 20 calibrates the hammer sensors 26 during the initialization of the electronic system 200 as follows. The initialization program is carried out immediately after the user starts to supply the electric power to the electric system 200.

Figure 4:
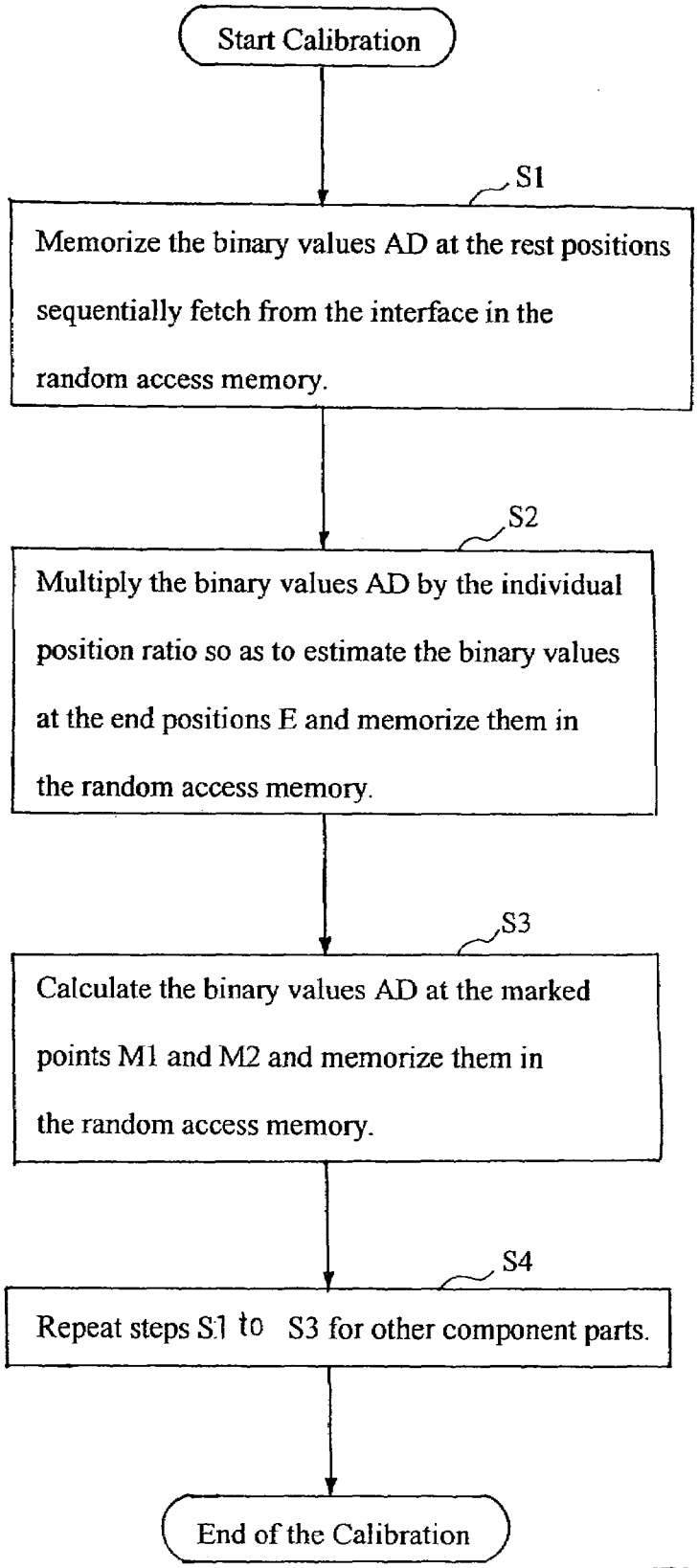
FIG. 4 is a flowchart showing a job sequence in a calibration work.

FIG. 4 shows a calibration work. A user is assumed to turn on the power switch. The central processing unit 20 starts to initialize the electronic system 200, and enters the program sequence shown in FIG. 4. All the hammers 2 are staying at the rest positions. First, the central processing unit 20 fetches the pieces of hammer position data or binary numbers AD from the signal interface 24, and memorizes the binary numbers AD in the random access memory 22 for the eighty-eight hammers 2 at the rest positions as by step S1. ADr stands for the binary values at the rest positions.

Subsequently, the central processing unit 20 reads out the values of the individual position ratio between the rest positions and the end positions from the read only memory 21, and multiplies the binary numbers AD at the rest position by the read-out values of the individual position ratios. Thus, the central processing unit 20 estimates the binary values AD at the end positions, and memorizes the estimated binary values in the random access memory 22 for the eighty-eight hammers 2 at the end positions as by step S2. ADe stands for the estimated binary values at the end positions.

Subsequently, the central processing unit 20 reads out the values of the individual position ratio between the rest positions and the marked points M1 and the values of the individual position ratio between the rest positions and the marked points M2 from the read only memory 21, and multiplies the binary numbers ADr at the rest position by the read-out values of the individual position ratios. Thus, the central processing unit 20 estimates binary values ADm1 at the marked points M1 and binary values ADm2 at the marked points M2, and memorizes the estimated binary values ADm1 and ADm2 in the random access memory 22 for the eighty-eight hammers 2 as by step S3. The binary values ADr and estimated binary values ADe, ADm1 and ADm2 serve as thresholds for current hammer status on the hammer trajectories.

In case where key sensors are installed in the acoustic piano 100, the calibration work is carried out for the key sensors through steps S1 to S3 so as to calibrate the key sensors as by step S4. If sensors are prepared for other component parts of the acoustic piano 100, the calibration works are further carried out for the associated sensors. When the calibration work or works are completed, the central processing unit 20 proceeds to another step for the initialization.

While the music data producer 27 is working on the pieces of hammer position data, the central processing unit 20 compares the pieces of hammer position data or binary values AD with the thresholds ADr, ADe, ADm1 and ADm2, and determines the current status of the hammers 2 on the hammer trajectories.

Figure 5:
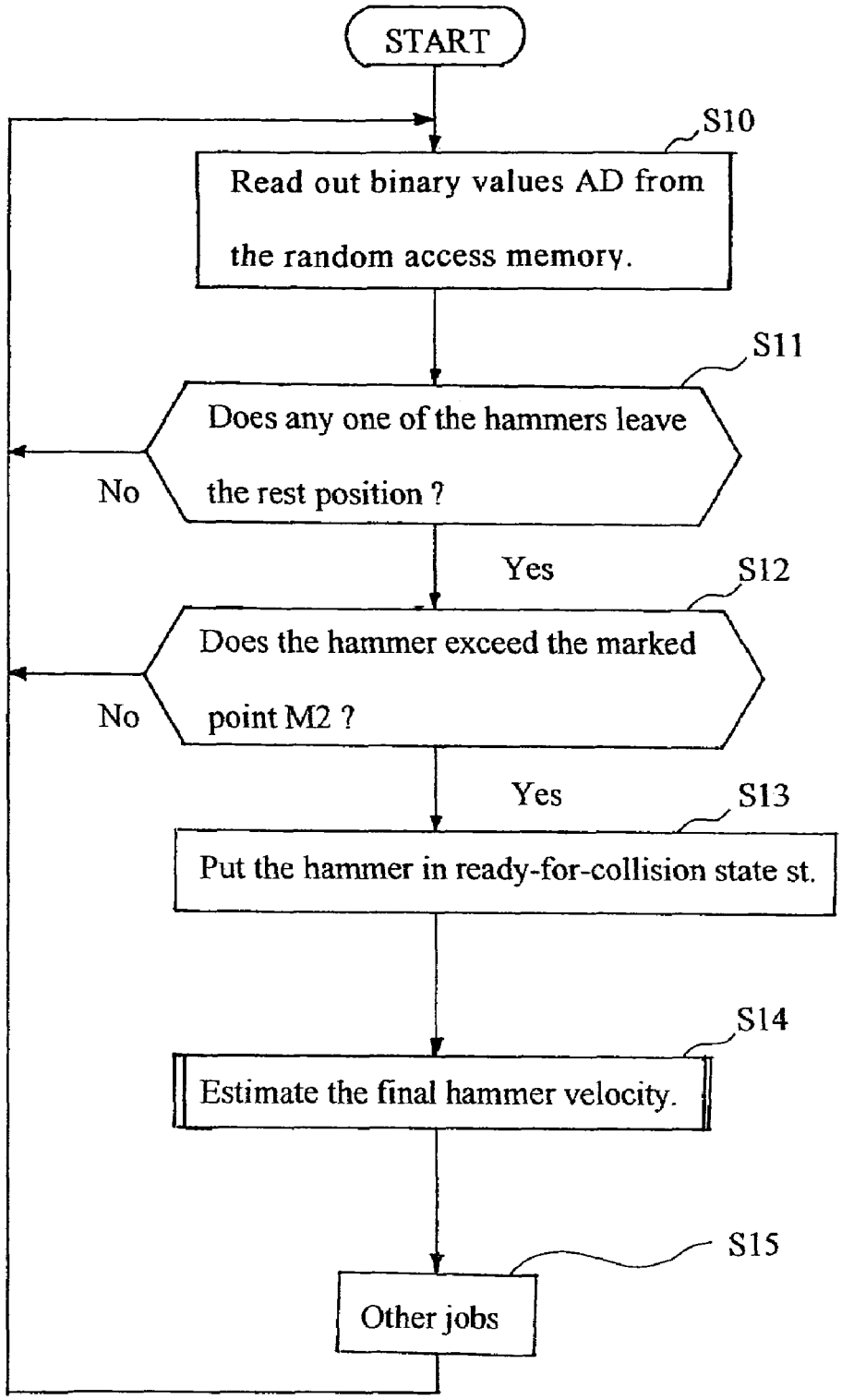
FIG. 5 is a flowchart showing a job sequence expressing a method for estimating a final hammer velocity.

Description is hereinafter made on a method for estimating the final hammer velocity with reference to FIG. 5. When the user instructs the electronic system 200 to record his or her performance, the main routine program starts periodically to branch to the subroutine program for the recording shown in FIG. 5. Though not shown in the drawings, the main routine program further periodically branches to a subroutine program for data fetch so as to put the pieces of plunger velocity data and pieces of hammer position data such as binary values AD in queues formed in the random access memory 22. The binary values AD are normalized so as to eliminate the individualities of the hammer sensors 26 therefrom before being entered into the queues. FIG. 6 shows one of the queues TABLE 1 assigned to a certain hammer 2. The binary values AD are labeled with the time TIME at which they are sampled, and twenty binary values AD form the queue. When a new binary value AD reaches the random access memory 22, the oldest binary value AD is pushed out from the queue, and the new binary value AD is put at the rear of the queue. Thus, the twenty binary values AD are maintained in the first-in and first-out fashion.

The main routine program is assumed to branch to the subroutine program for the recording. Although the execution is periodically interrupted, description is made on the subroutine program for the recording as if the execution is continued without any interruption.

The central processing unit 20 reads out the binary values AD from the rears of the queues TABLE 1 as by step S10, and checks the binary values AD to see wither or not any one of the hammers 2 leaves the rest position as by step S11. If the binary values AD are equal to the thresholds ADr, the central processing unit 20 decides that the hammers 2 are still staying at the rest positions, and the answer at step S11 is given negative "No". With the negative answer "No", the central processing unit 20 returns to the main routine program. If, on the other hand, the central processing unit 20 finds a binary value AD greater than the threshold ADr, the central processing unit 20 decides that the hammer 2 has leaved the rest position, and the answer is given affirmative "Yes".

With the positive answer at step S11, the central processing unit 20 compares the binary value AD with the threshold ADm2 to see whether or not the hammer 2 has passed the marked point M2 as by step S12. While the hammer 2 is traveling between the rest position and the marked point M2, the answer at step S12 is given negative "No", and the central processing unit 20 returns to the main routine program.

However, if the hammer 2 has passed the marked point M2, the hammer 2 is found to be immediately before the collision with the string 4, and the central processing unit 20 puts the hammer 2 in the ready-for-collision state st as by step S13. In more detail, the central processing unit 20 changes the flag assigned to the hammer 2 from the off-state to the ready-for-collision state st.

With the positive answer "Yes", the central processing unit 20 proceeds to step S14, and estimates the final hammer velocity as will be hereinafter described in detail. The central processing unit 20 estimates the final hammer velocity in the vicinity of the marked point M2, and employs different methods depending upon characteristic of the hammer motion.

Upon completion of the estimation at step S14, the central processing unit 20 executes other jobs. One of the other jobs is to normalize the pieces of music data, and another job is to store the pieces of music data in a music data code.

Figure 7:
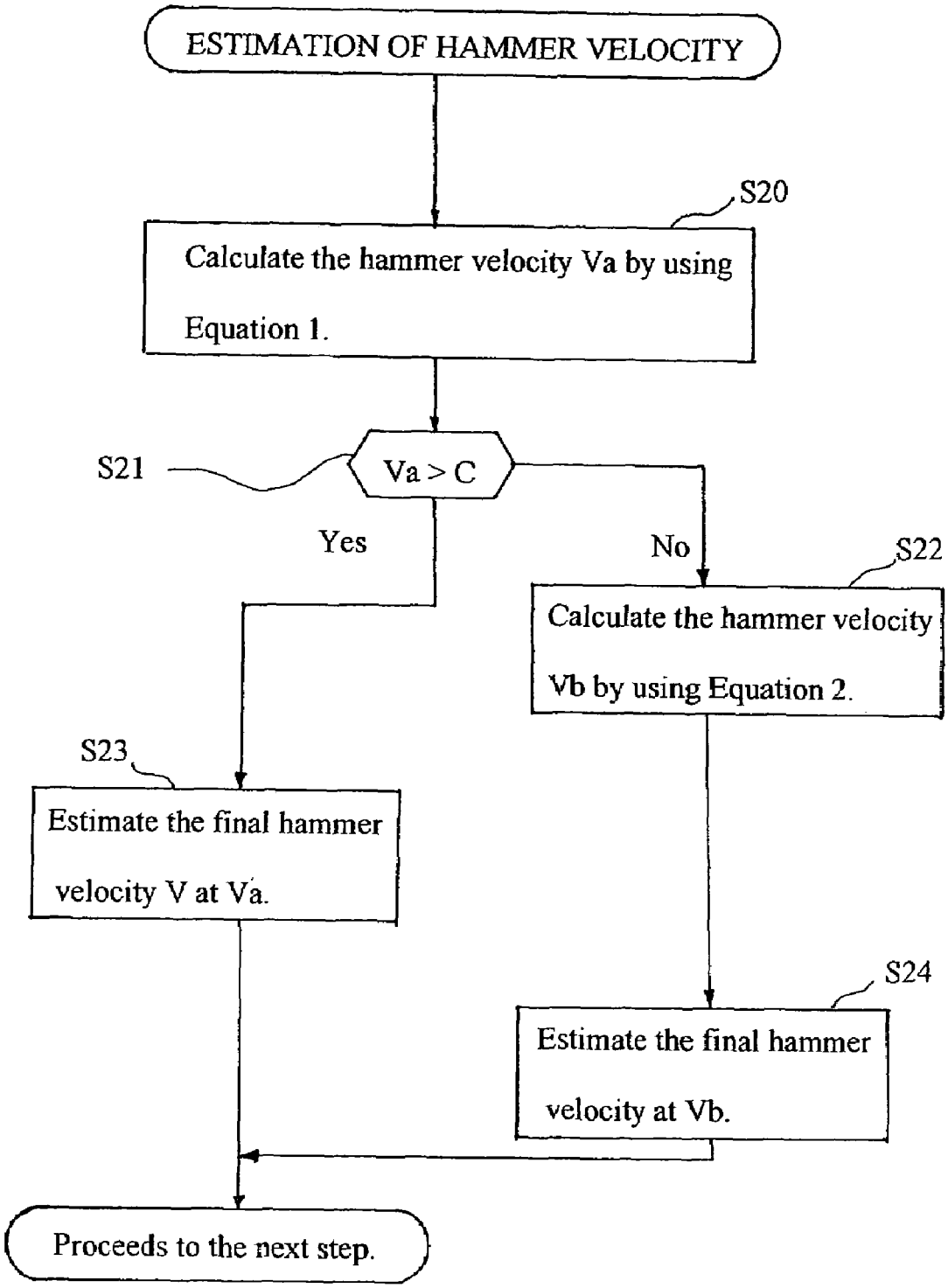
FIG. 7 is a flowchart showing a job sequence for estimating the final hammer velocity.
Figure 8:
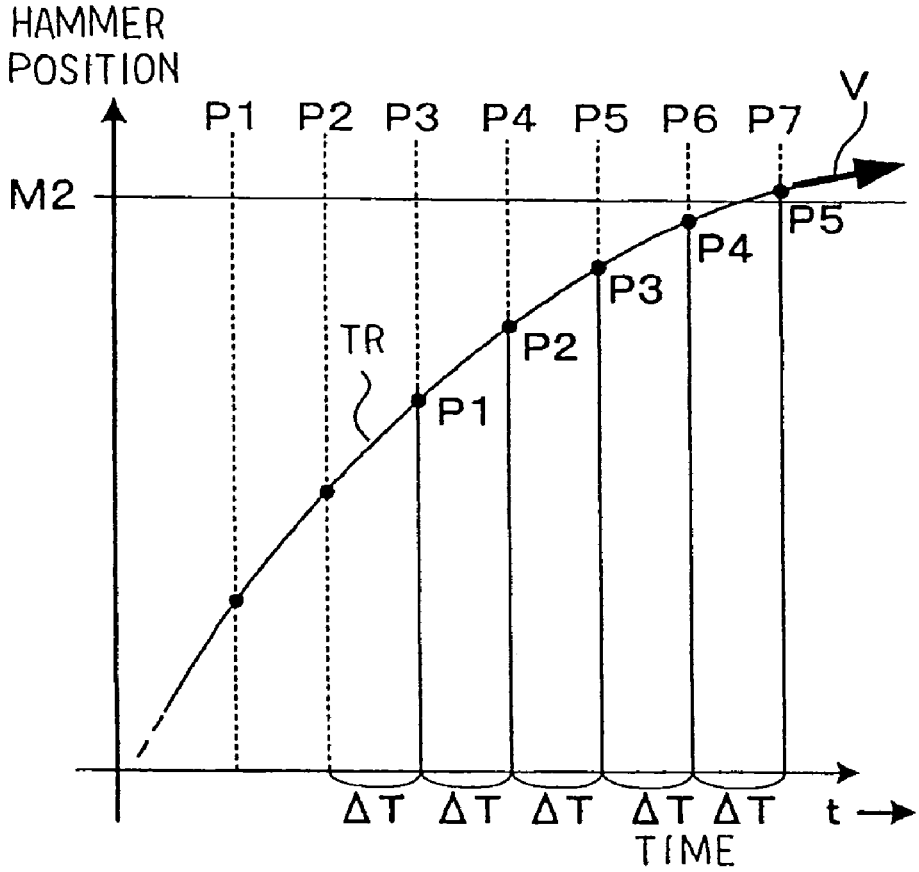
FIG. 8 is a graph showing hammer positions expressed by binary numbers on a hammer trajectory.

Turning to FIG. 7, when the central processing unit 20 proceeds to step S14, the central processing unit firstly calculates a hammer velocity Va by using the following equation 1 as by step S20.

$$Va=1/\Delta T\times\{(-2P1-P2+0\times P3+P4+2P5)/10\} \quad \text{Equation 1}$$

where ΔT is the intervals of the sampling, P5 is the binary number AD at the rear of the queue and P4, P3, P2, P1 are the binary numbers AD entered in the queue before the binary number P5 as shown in FIG. 8. Thus, the central processing unit 20 determines the gradient at the marked point M2 or the latest point after the marked point M2 through a linear approximation technique. In equation 1, coefficients, i.e., −2, −1, 0, +1 and +2 are theoretically determined on the assumption that every binary numbers P1, P2, P3, P4 and P5 are found on a linear line.

When the central processing unit 20 determines the hammer velocity Va, the central processing unit 20 proceeds to step S21, and compares the hammer velocity Va with a critical value C to see whether or not the hammer velocity Va is greater than the critical value C. If the hammer 2 travels on the hammer trajectory TR1 at relatively high-speed, the answer at step S21 is given affirmative "Yes", and the central processing unit 20 estimates the final hammer velocity V at Va as by step S23.

If, on the other hand, the hammer 2 travels on the hammer trajectory TR1 at relatively low-speed, the answer at step S21 is given negative "No", and the central processing unit 20 calculates a hammer velocity Vb by using Equation 2.

$$Vb=1/\Delta T\times\{(26P1-27P2-40P3-13P4+54P5)/70\} \quad \text{Equation 2}$$

The latest binary value P5 is indicative of a hammer position at the marked point M2 or after the marked point M2, and the other binary value P4, P3, P2 and P1 are found on the hammer trajectory before the marked point M2 as similar to those in Equation 1. The coefficients in Equation 2 are theoretically determined on the assumption that all the binary numbers P1, P2, P3, P4 and P5 are found on a quadratic curve such as, for example, a parabolic curve. Thus, the central processing unit 20 calculates the hammer velocity Vb by using a quadratic curve approximation.

Subsequently, the central processing unit 20 estimates the final hammer velocity V at Vb as by step S24. Upon completion of the jobs at step S23 or S24, the central processing unit 20 proceeds to step S15.

As already described with reference to FIGS. 11A and 11B, the hammer trajectory in the high-speed hammer motion is close to a linear line, and the hammer trajectory in the low-speed hammer motion is approximated to a gentle curve toward the end position of the hammer 2. Therefore, Equations 1 and 2 are proper for the approximation. Thus, the central processing unit 20 estimates the final hammer velocity V through the different methods depending upon the characteristic of the hammer motion, i.e., the velocity Va/Vb of the hammer 2 determined through the approximation techniques.

In case where the velocity Va around the critical value C is discontinued with the velocity Vb around the critical value C, it is desirable to assume a line in the range around the critical value C so as to make the velocity Va smoothly merged with the velocity Vb.

Figure 9:
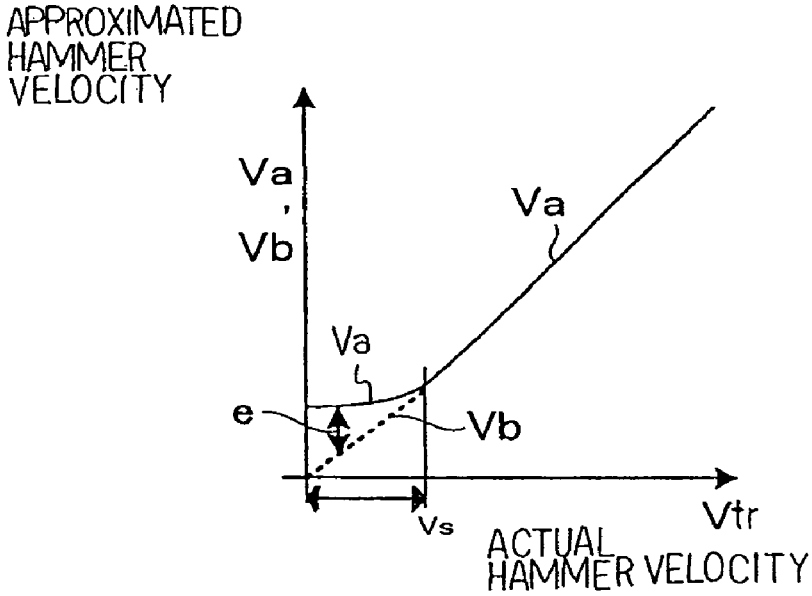
FIG. 9 shows a graph showing relation between a linear approximation and an approximation of a curve of the second order.

The accuracy of the approximation techniques is shown in FIG. 9. When a hammer was moved at actual hammer velocity Vtr, the central processing unit 20 estimated the hammer velocity as indicated by plots Va and Vb. The plots Va and Vb stood for the hammer velocity approximated through the linear approximation technique and the hammer velocity approximated through the quadratic curve approximation technique. Though not clear from FIG. 9, the approximated hammer velocity Va contained noise less rather than the approximated hammer velocity Vb, and the approximated hammer velocity Vb was dispersed wider than the approximated hammer velocity Va. When the hammer was moved at the actual hammer velocity Vtr less than the critical hammer velocity Vs, the approximated hammer velocity Va was deviated from the actual hammer velocity Vtr by value e. However, the approximated hammer velocity Vb was close to the actual hammer velocity Vtr. Thus, the linear approximation was preferable to the quadratic curve approximation over the critical hammer velocity Vs, and the quadratic curve approximation was desirable rather than the linear approximation below the critical velocity Vs. This is the reason why the different approximation techniques are employed in the subroutine program for the recording. The critical value C is determined on the basis of the critical hammer velocity Vs.

Second Embodiment

Figure 10:
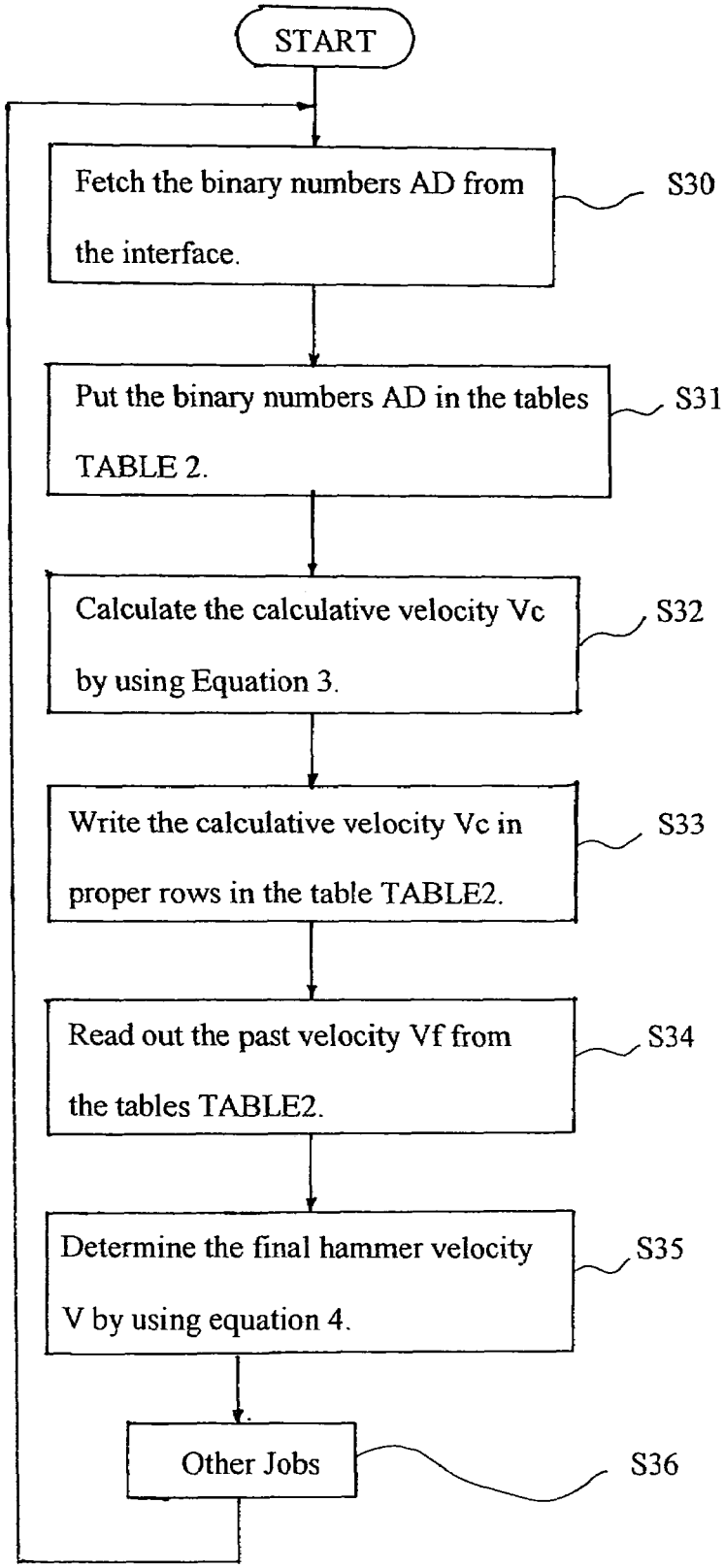
FIG. 10 is a flowchart showing a subroutine program for recording employed in an electronic system of another automatic player piano.

Another automatic player piano embodying the present invention also comprises an acoustic piano and an electronic system. The acoustic piano is similar in structure to the acoustic piano 100, and the electronic system is identical in hardware with the electronic system 200. A computer program is same as the computer program installed in the controller 200*a* except for a subroutine program for the recording shown in FIG. 10. For this reason, description is focused on the estimation program, and component parts of the acoustic piano and system components of the electronic system are hereinafter labeled with the references designating the component parts of the acoustic piano 100 and the system components of the electronic system 200.

A user is assumed to instruct the electronic system to record his or her performance. While the user is fingering a piece of music on the acoustic piano, the main routine program periodically branches to the subroutine program for the recording.

The central processing unit 20 fetches the binary numbers AD representative of the pieces of hammer position data from the signal interface 24, and normalizes the pieces of hammer position data as by step S30. The central processing unit 20 puts the binary numbers AD in tables TABLE 2 respectively assigned to the eighty-eight hammers 2 as by step S31. FIG. 11 shows one of the tables TABLE 2. The first column, second column, third column and fourth column are respectively assigned the sampling time T, binary numbers AD, a calculative velocity Vc and an estimated hammer velocity V. Eleven binary numbers ADx(−5), ADx(−4), . . . , ADx(0), . . . and ADx(5) and their sampling time are accumulated in the second and first columns in the first-in and first-out fashion. The calculative velocity Vc and estimated hammer velocity V are hereinafter described in detail.

Subsequently, the central processing unit 20 calculates the calculative velocity Vc by using equation 3 as by step S32. In other words, the calculative velocity Vc is defined as equation 3.

$$Vc=\{\Sigma(wj\times xj)\}/W \qquad \text{Equation 3}$$

where xi is the binary number ADx(−5) to ADx(5) and wj are coefficients selected from a table shown in FIG. 12. In the table shown in FIG. 12, rows respectively assigned to "n", "m", "W" and "j"="−6" to "6" are indicative of the number of terms in equation 3, the term at the center of equation 3, the value of W in equation 3 and coefficients for the terms in equation 3, respectively. For example, when the central processing unit 20 calculates the calculative velocity Vc on the basis of the eleven binary numbers ADx(−5) to ADx(5), i.e., n is 11, the coefficient W is 110, and the coefficients "−5", "−4", "−3", "−2", "−1", "0", "1", "2", "3", "4" and "5" are selected from the table for the first term (w1×x(−5)) to the last term (w5×x(5)).

Since the calculative velocity Vc is calculated at the mid point of the total sampling time period for the eleven binary numbers ADx(−5) to ADx(5), the hammer 2 traveled on the hammer trajectory at the calculative velocity Vc, and the hammer 2 may presently change the velocity. In other words, the calculative velocity Vc is the velocity at the past sampling time spaced from the latest sampling time by m sampling periods, i.e., m×ΔT. For this reason, the central processing unit 20 writes the calculative velocity Vc in the row m rows over the lowest row as by step S33. In case where the calculative velocity Vc is determined on the basis of the eleven binary numbers ADx(−5) to ADx(5), the calculative velocity Vc is written as Vc(0) at T=5.

Subsequently, the central processing unit 20 estimates the final hammer velocity at the sampling time T=10. If all the hammer motion were categorized in the high-speed motion shown in FIG. 1A, the central processing unit 20 would assume the final hammer velocity V to be equal to the calculative velocity Vc. However, the hammer motion is not always categorized in the high-speed motion. When a user softly depresses a black/white key 1*a*/1*b*, the hammer 2 travels on the parabolic trajectory so that the central processing unit 20 can not estimate the final hammer velocity V at Vc. For this reason, the central processing unit 20 further calculates the final hammer velocity V on the basis of the calculative velocity Vc in accordance with the present invention.

The central processing unit 20 reads out past velocity Vf from the tables TABLE 2 as by step S34. The past velocity Vf was written in the row assigned to the calculative velocity Vc(m−k) before the row assigned to the calculative velocity Vc at m by k sampling time periods. In other words, the past velocity Vf is identical with the calculative velocity Vc at (m−k) written in the tables TABLE 2 earlier than the calculative velocity Vc at m by (k×ΔT). For example, m and k are assumed to be 5 and 2. When the time 10, i.e., T=10 comes, the central processing unit 20 determines the calculative velocity Vc at T=5, and reads out the past velocity Vf from the row at T=3.

Since the acceleration A at (m−k) is given as A=(Vc−Vf)/(k×ΔT), the final hammer velocity V is expressed on the assumption that the hammer 2 travels in uniform acceleration motion.

$$\begin{aligned} V &= Vc + A\times m\times \Delta T \qquad \text{Equation 4}\\ &= Vc + (Vc - Vf)/(k\times\Delta T)\times m\times\Delta T\\ &= Vc + (Vc - Vf)/k\times m\\ &= (k\times m)/k\times Vc - m/k\times Vf \end{aligned}$$

The central processing unit 20 estimates the final hammer velocity V by using equation 4 as by step S35, and writes the final hammer velocity V in the tables TABLE 2. Thus, the central processing unit 20 estimates the final hammer velocity V on the basis of the calculative velocity Vc.

The central processing unit 20 proceeds from step S35 to step S36. The central processing unit 20 checks the status flag to see whether or not the hammer 2 has passed the marked point M2. If the hammer 2 is still traveling on the trajectory before the marked point M2, the central processing unit 20 immediately returns to step S30. On the other hand, when the central processing unit 20 finds the hammer 2 to have already passed the marked point M2, the central processing unit 20 determines the key number assigned to the black/white key 1*a*/1*b* associated with the hammer 2 and time at which the tone is to be produced, and memorizes the sort of key event, key number or numbers, time and values of final hammer velocity V in the music data codes as by step S36. When the central processing unit 20 finds the hammer 2 on the way toward the rest position, the jobs are different from those hereinbefore described.

Upon completion of the jobs at step S36, the central processing unit 20 returns to step S30. Thus, the central processing unit 20 reiterates the loop consisting of steps S30 to S36 so as to produce the music data codes. As described hereinbefore, the central processing unit 20 fetches the pieces of hammer position data at the regular intervals ΔT so that the central processing unit 20 waits for the time to fetch the piece of hammer position data between steps S36 and S30.

Figure 13A:
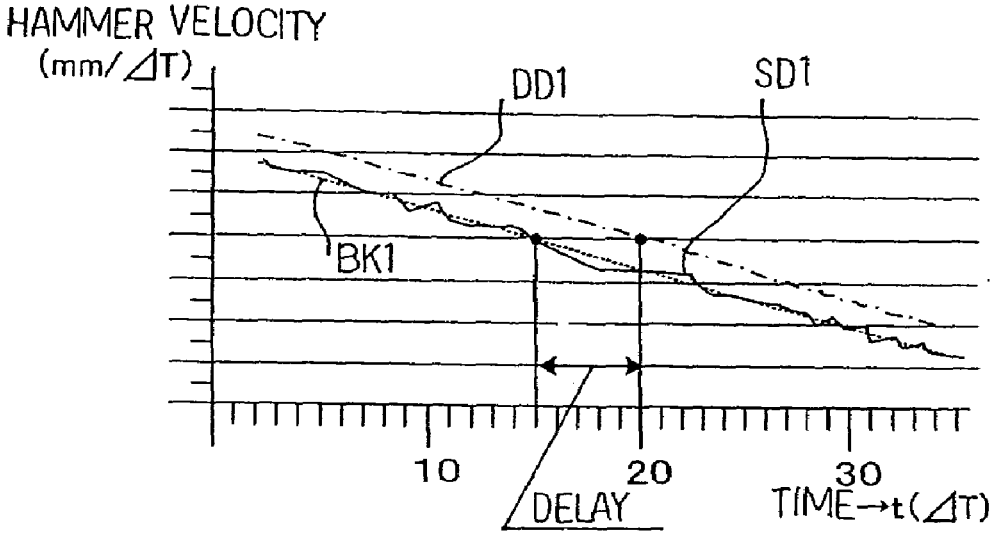
FIGS. 13A and 13B are graphs showing experiments on evaluation of estimated hammer velocity and hammer stroke.
Figure 13B:
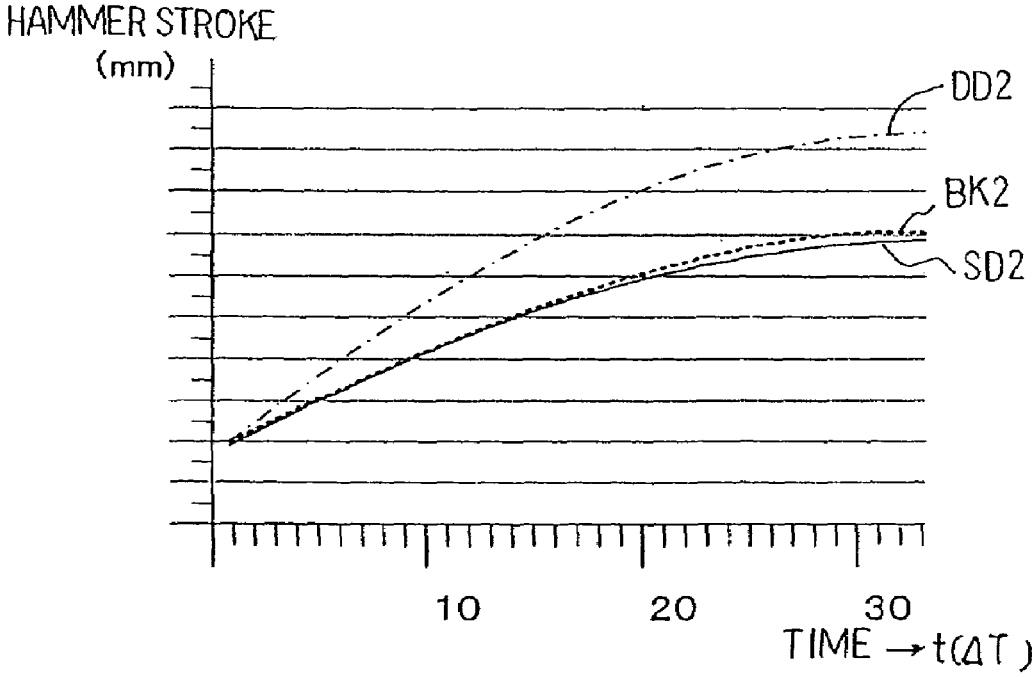

The present inventors evaluated the velocity estimation method at step S35. The present inventors moved the hammer at different values of actual velocity, and plotted the actual hammer velocity as indicated by broken lines BK1 as shown in FIG. 13A. The present inventors instructed the controller to convert the discrete values of the hammer position signals to binary numbers at regular intervals of 1 millisecond, i.e., ΔT=1 ms, and further instructed the controller to determine the calculative velocity Vc and final hammer velocity V by using equation 3 and equation 4. The number of binary numbers AD was 11, and K was 2.

The present inventors plotted the calculative velocity Vc and final hammer velocity V as indicated by dot-and-dash line DD1 and solid line SD1 in FIG. 13A. The calculative velocity Vc was delayed from the actual hammer velocity BK1 by 5×ΔT. Comparing plots SD1 with plots BK1, it was understood that, although noise component unavoidably rode on plots SD1, the final hammer velocity SD1 was very close to the actual hammer velocity BK1. The present inventors concluded that the estimation of final hammer velocity V was valuable.

The present inventors further plotted the actual hammer stroke, calculative hammer stroke and final hammer stroke as indicated by broken line BK2, dot-and-dash line DD2 and solid line SD2, respectively. The calculative hammer stroke and final hammer stroke were equal to the integral of the calculative velocity Vc and integral of final hammer velocity V. Plots SD2 were very close to plots BK2.

As will be understood from the foregoing description, the central processing unit 20 determines the calculative velocity Vc through the polynomial approximation on the values of hammer position actually measured, and, thereafter, estimates the final hammer velocity V on the assumption that the hammers 2 travel in the uniform acceleration motion in accordance with the present invention. The final hammer velocity thus estimated is well consistent with the actual hammer velocity. Thus, the recorder according to the present invention produces the music data codes expressing the tones at high fidelity.

Although particular embodiments of the present invention have been shown and described, it will be apparent to those skilled in the art that various changes and modifications may be made without departing from the spirit and scope of the present invention.

The hammer stroke between the rest positions and the end positions is an example, and is different in another model of the acoustic piano.

The plunger sensors may produce plunger position signals also representative of the plunger motion and, accordingly, key motion.

The sensor matrix does not set any limit to the technical scope of the present invention. Photo-couplers may be provided for the hammers, respectively. The optical transducers may be replaced with velocity sensors or acceleration sensors, because the controller can convert one of the position, velocity and acceleration to another of them.

The MIDI protocols do not set any limit to the technical scope of the present invention. Any data protocols are available for the electronic system 200 in so far as the computer program can interpret the pieces of music data memorized in the data codes. For example, the motion may be expressed as the keystroke varied with time.

In the first embodiment, the linear approximation and quadratic curve approximation are carried out on the basis of the five binary numbers P1, P2, P3, P4 and P5. However, the five binary numbers P1 to P5 do not set any limit to the technical scope of the present invention. The linear approximation and quadratic curve approximation may be based on seven binary numbers P1, P2, P3, P4, P5, P6 and P7 as follows.

$$Va=1/\Delta T\times\{(-3P1-2P2-P3+0\times P4+P5+2P6+3P7)/28\} \quad \text{Equation 5}$$

$$Vb=1/\Delta T\times\{(7P1-2P2-7P3-8P4-5P5+2P6+13P7)/28\} \quad \text{Equation 6}$$

In FIG. 7, the hammer velocity Va is calculated at step S20. However, if the hammer velocity Va is equal to or less than the critical value C, the central processing unit 20 is to calculate the hammer velocity Vb. In other words, both of the linear approximation and quadratic curve approximation are to be carried out. It is time consuming. The central processing unit 20 may differentiate the binary numbers, i.e., (P5-P4)/ΔT so as to compare the result with the critical value C. When the result is greater than the critical value C, the central processing unit 20 calculates the hammer velocity Va through the linear approximation. If, on the other hand, the result is equal to or less than the critical value C, the central processing unit 20 calculates the hammer velocity Vb through the quadratic curve approximation.

If the key sensor is installed in the automatic player piano, the central processing unit takes the key velocity into account so as to decide which approximation technique is to be employed.

In the second embodiment, the central processing unit 20 estimates the final hammer velocity V regardless of the category of hammer motion. A decision step, at which the central processing unit 20 compares the calculative velocity Vc with the critical value C, may be inserted between steps S33 and S34. If the calculative velocity Vc is greater than the critical value C, the central processing unit 20 estimates the final hammer velocity V at Vc without any execution at steps S34 and S35. On the other hand, if the calculative velocity Vc is equal to or less than the critical value C, the central processing unit 20 proceeds to step S35 through step S34.

The polynomial approximation may be carried out on the samples less than or greater than 11. As well known to the persons skilled in the art, the more the samples are, the higher the accuracy is.

The controller 200*a* may further fetch pieces of key position data expressing the key stroke so as to determine the timing to start the key motion.

The analysis on the hammer motion may be carried out through wired-logic circuits.

The automatic player piano may be fabricated on the basis of an upright piano. However, the automatic player piano does not set any limit to the technical scope of the present invention. Only the recorder may be installed in the acoustic piano.

Another sort of hybrid musical instrument to which the present invention will appertain is a mute piano. The mute piano is equipped with a hammer stopper, which is changed between a free position and a blocking position. While the hammer stopper is staying at the free position, the hammer stopper is out of the hammer trajectories, and permits the hammers to be brought into collision with the strings. However, when the hammer stopper is changed to the blocking position, the hammer stopper is moved into the hammer trajectories, and the hammers rebound on the hammer stopper before striking the strings. Thus, any acoustic piano tone is not produced. An electronic tone generating system is installed in the acoustic piano. While the pianist is fingering on the acoustic piano with the hammer stopper at the blocking position, the key motion and/or hammer motion is monitored with the sensors, and the electronic tone generating system produces the music data codes as similar to the recorder of the automatic player piano. The music data codes are transferred to an electronic tone generator, and electronic tones are produced through a headphone.

The velocity estimator according to the present invention may be installed in an electronic piano, an organ or a celesta. Thus, the acoustic piano does not set any limit to the technical scope of the present invention.

An estimator according to the present invention may categorize the hammer motion in either high-speed or low-speed before the marked point M2 so as to determine the equation used for calculating the final hammer velocity after the marked point M2.

The component parts of the above-described embodiments are correlated with claim languages as follows. The controller 200*a* and step S14 or steps S30 to S35 in the subroutine programs serve as "an estimator", and the queues TABLE 1 or tables TABLE 2 are corresponding to "a data storage". The hammers 2 are corresponding to "a component part" and "certain links". The keyboard 1, action units 3, hammers 2 and strings 4 as a whole constitute "plural series of links". The current hammer position or hammer stroke is corresponding to "a sort of physical quantity", and hammer velocity is equivalent to "another sort of physical quantity". The acceleration of the hammer is corresponding to "yet another sort of physical quantity". The hammer sensors 26 serve as "sensors". The hammer velocity is equivalent to a "character" of motion.

What is claimed is:

1. An estimator for a physical quantity expressing motion of a component part of a musical instrument, comprising:

a data storage storing series of values of a piece of motion data expressing a sort of physical quantity varied on a trajectory on which said component part travels; and a data processor connected to said data storage, and determining another sort of physical quantity expressing said motion of said component part on the basis of said series of values of said piece of motion data through methods for estimating a value of said another sort of physical quantity by using equations different from one another and selectively used depending upon a characteristic of said motion, wherein said equations are expressed as $$PQ=1/\Delta T\times\{(C1\times P1, \ldots +Cn\times Pn)/M\},$$

where PQ is said another sort of physical quantity, P1, . . . , Pn are said series of values of said piece of motion data, n is a natural number equal to the number of said values of said series, C1, . . . , Cn are coefficient for said P1 to Pn different among said methods, M is a coefficient different among said methods and ΔT is a time interval between adjacent two of said series of values.

2. The estimator as set forth in claim 1, in which one of said equations expresses a linear approximation, and the other of said equations expresses an approximation of a curve of the second order.

3. The estimator as set forth in claim 1, in which said PQ stands for velocity, and said piece of motion data expresses a current position of said component part varied on said trajectory.

4. The estimator as set forth in claim 1, in which said data processor calculates said another sort of physical quantity on the assumption that said trajectory is expressed by a linear line, compares the value of said another sort of physical quantity on said assumption with a critical value to see whether or not said value is greater than said critical value, and recalculates said another sort of physical quantity on the assumption that said trajectory is expressed by a curve of second order when said value is greater than said critical value.

5. The estimator as set forth in claim 1, in which each of said methods further includes a step of modifying a value of said another sort of physical quantity by using yet another sort of physical quantity on said trajectory, and said yet another sort of physical quantity makes said methods different from one another.

6. The estimator as set forth in claim 5, in which a value of said another sort of physical quantity is expressed as $$PQ=\{\Sigma(wj\times xj)\}/W$$

where xj are said series of values of said piece of motion data, j are a natural number equal to the number of terms, wj are coefficient for wj and W is another coefficient different in dependence of said natural number and PQ is a value of said another sort of physical quantity at past time.

7. The estimator as set forth in claim 6, in which a value of said another sort of physical quantity is calculated at a time after said past time through the modification with said yet another sort of physical quantity.

8. The estimator as set forth in claim 7, in which said value PQx of said another sort of physical quantity at said time is estimated as $$PQx=PQ+A\times m\ \Delta T$$

where A is a differential of the equation defined in claim 6 at said past time, mΔT is a lapse of time between said past time and said time.

9. The estimator as set forth in claim 8, in which said another sort of physical quantity is a velocity of said component part on said trajectory so that said differential expresses acceleration.

10. A musical instrument for producing pieces of music data expressing tones, comprising:

plural series of links having respective certain links traveling on trajectories, respectively, for specifying said tones to be produced;

sensors producing signals representative of pieces of motion data expressing a sort of physical quantity varied on said trajectories so that plural series of values of said pieces of motion data express motion of said certain links on said trajectories;

an estimator connected to said sensors, and including a data storage storing said plural series of values of said pieces of motion data and a data processor connected to said data storage and determining another sort of physical quantity expressing said motion of said certain links on the basis of said plural series of values of said pieces of motion data through methods for estimating a value of said another sort of physical quantity by using equations different from one another and selectively used depending upon a characteristic of said motion, wherein said equations are expressed as $$PQ=1/\Delta T\times\{(C1\times P1, \ldots +Cn\times Pn)/M\},$$

where PQ is said another sort of physical quantity, P1, . . . , Pn are said series of values of said piece of motion data, n is a natural number equal to the number of said values of said series, C1, . . . , Cn are coefficient for said P1 to Pn different among said methods, M is a coefficient different among said methods and ΔT is a time interval between adjacent two of said series of values; and a music data producer connected to said estimator, and producing pieces of music data expressing said tones, said pieces of music data containing sub-pieces of music data expressing an attribute of said tones determined on the basis of said another sort of physical quantity.

11. The musical instrument as set forth in claim 10, in which each of said plural series of links includes a key pitching up and down with respect to a component part shared with other keys incorporated in the others of said plural series of links.

12. The musical instrument as set forth in claim 11, in which said each of said plural series of links further includes an action linked with said key, a hammer driven for rotation by said action and serving as one of said certain links, and a string struck with said hammer at an end of said rotation so as to produce one of said tones.

13. The musical instrument as set forth in claim 12, in which a stroke of said hammer measured from a rest position is said sort of physical quantity, and velocity of said hammer is said another of physical quantity.

14. The musical instrument as set forth in claim 10, in which one of said equations expresses a linear approximation used in one of said methods for said hammers traveling in high-speed motion, and the other of said equations expresses an approximation of a curve of the second order used in another of said methods for said hammers traveling in low-speed motion so that said character is the magnitude of said velocity.

15. The musical instrument as set forth in claim 13, in which each of said methods includes a step of estimating said velocity on the basis of a series of values of said stroke and a step of modifying a value of said velocity by using acceleration of said hammers on said trajectories, and said acceleration makes said methods different from one another.

16. The musical instrument as set forth in claim 15, in which a value of said velocity is expressed as $$PQ=\{\Sigma(wj\times xj)\}/W$$

where xj are each of said plural series of values of said pieces of motion data expressing said stroke, j are a natural number equal to the number of terms, wj are coefficient for wj and W is another coefficient different in dependence of said natural number and PQ is a value of said velocity at past time.

17. The musical instrument as set forth in claim 16, in which a value PQx is determined at a time after said past time through the modification using an equation expressed as $$PQx=PQ+A\times m\Delta T$$

where A is a differential of the equation defined in claim 16, at said past time, mΔT is a lapse of time from said past time and said time.

* * * * *